US011548715B2

(12) United States Patent
Jeong et al.

(10) Patent No.: US 11,548,715 B2
(45) Date of Patent: Jan. 10, 2023

(54) MAIN CONTAINER FOR MIXING COSMETIC, SUB CONTAINER FOR MIXING COSMETIC, AND COSMETIC PRODUCT INCLUDING SAME

(71) Applicant: AMOREPACIFIC CORPORATION, Seoul (KR)

(72) Inventors: Hae Won Jeong, Yongin-si (KR); Kyungho Choi, Yongin-si (KR); Seo Hui Jeong, Incheon (KR)

(73) Assignee: AMOREPACIFIC CORPORATION, Seoul (KR)

( * ) Notice: Subject to any disclaimer, the term of this patent is extended or adjusted under 35 U.S.C. 154(b) by 384 days.

(21) Appl. No.: 16/713,796

(22) Filed: Dec. 13, 2019

(65) Prior Publication Data

US 2020/0189827 A1 Jun. 18, 2020

(30) Foreign Application Priority Data

Dec. 14, 2018 (KR) ..... 10-2018-0161959

(51) Int. Cl.
*B65D 81/32* (2006.01)
*A45D 34/00* (2006.01)
(Continued)

(52) U.S. Cl.
CPC ..... *B65D 81/3211* (2013.01); *A45D 34/00* (2013.01); *B01F 27/808* (2022.01);
(Continued)

(58) Field of Classification Search
CPC ..... B65D 81/3211; A45D 34/00; A45D 2200/058; A45D 2034/005; A45D 2200/053; B01F 2101/21
(Continued)

(56) References Cited

U.S. PATENT DOCUMENTS 5,421,483 A * 6/1995 Parise ..... B05B 11/0078 222/129
6,041,969 A * 3/2000 Parise ..... B05B 11/0078 222/129
(Continued)

FOREIGN PATENT DOCUMENTS

KR 200294064 11/2002
KR 200464645 Y1 1/2013
(Continued)

OTHER PUBLICATIONS

Korean Office Action—Korean Patent Application No. 10-2018-0161959 dated Feb. 27, 2020.

*Primary Examiner* — Luan K Bui
(74) *Attorney, Agent, or Firm* — Cantor Colburn LLP

(57) ABSTRACT

A main container and a sub container for mixing cosmetic and a cosmetic product including the same provides a cosmetic product including a first container providing a first storing space which stores a first fluid, and in which fluid can be mixed; a discharging unit which discharges a fluid stored in the first container to the outside; and a second container which can be coupled to the first container, and which can discharge a second fluid stored in the second container to the first storing space. The second container has a storing state to store the second fluid and an open state to discharge the second fluid, wherein the second container to the open state by the discharging unit being coupled to the first container, and wherein as the second container is converted to the open state, the second fluid is discharged to the first storing space.

15 Claims, 6 Drawing Sheets

(51) Int. Cl.
*B01F 27/92* (2022.01)
*B01F 27/808* (2022.01)
*B01F 101/21* (2022.01)

(52) U.S. Cl.
CPC ..... *B01F 27/92* (2022.01); *A45D 2034/005* (2013.01); *A45D 2200/053* (2013.01); *A45D 2200/058* (2013.01); *B01F 2101/21* (2022.01)

(58) Field of Classification Search
USPC ..... 206/219–222, 568; 222/129, 383–1, 222/383.2, 384, 385
See application file for complete search history.

(56) References Cited

U.S. PATENT DOCUMENTS

| | | | | |
|---|---|---|---|---|
| 6,290,100 | B1 * | 9/2001 | Yacko | B05B 11/0081 222/510 |
| 8,794,474 | B2 * | 8/2014 | Mueller | B05B 11/0081 215/44 |
| 2004/0233777 | A1 * | 11/2004 | Adams | B44D 3/08 366/339 |
| 2005/0174881 | A1 * | 8/2005 | Ki | B65D 81/3211 206/219 |
| 2008/0116221 | A1 * | 5/2008 | Roth | B65D 47/243 222/129 |
| 2010/0084430 | A1 * | 4/2010 | Sim | B65D 81/3222 222/129 |

FOREIGN PATENT DOCUMENTS

| | | |
|---|---|---|
| KR | 1020160098712 | 8/2016 |
| KR | 2020170003449 | 10/2017 |

* cited by examiner

【FIG. 1】
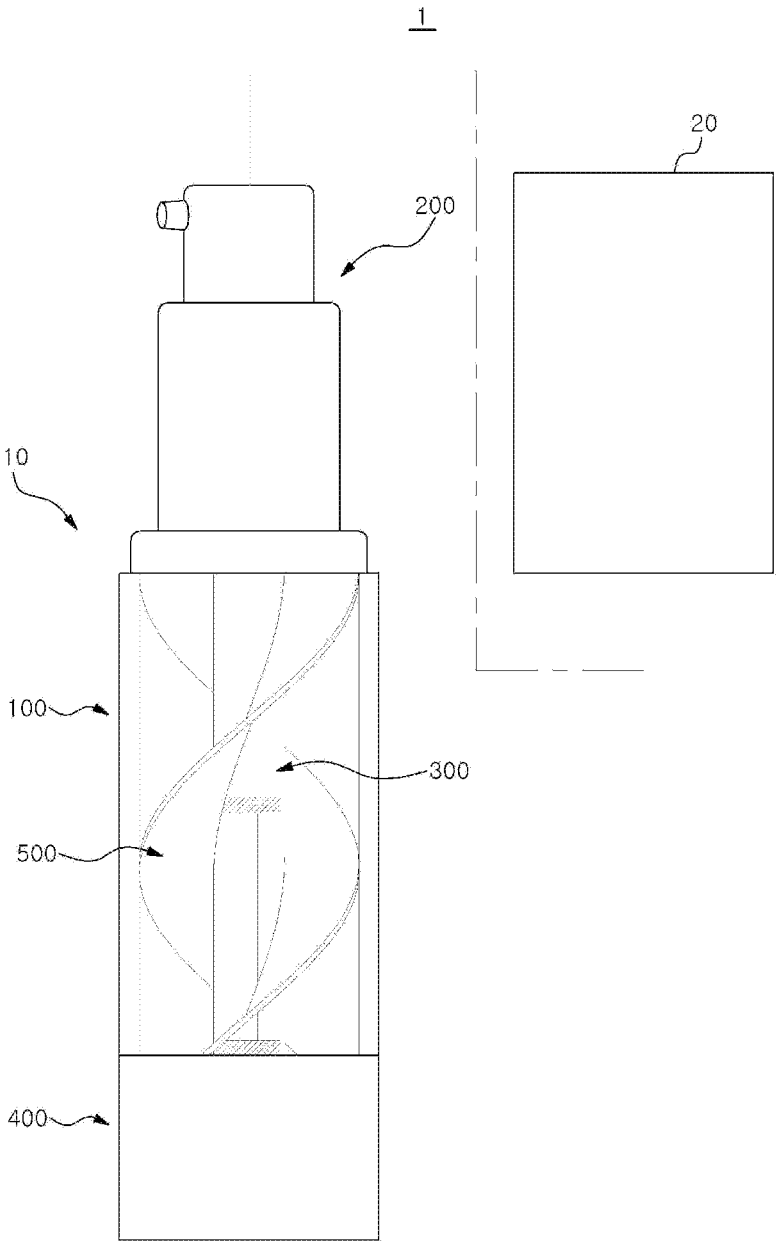

【FIG. 2】
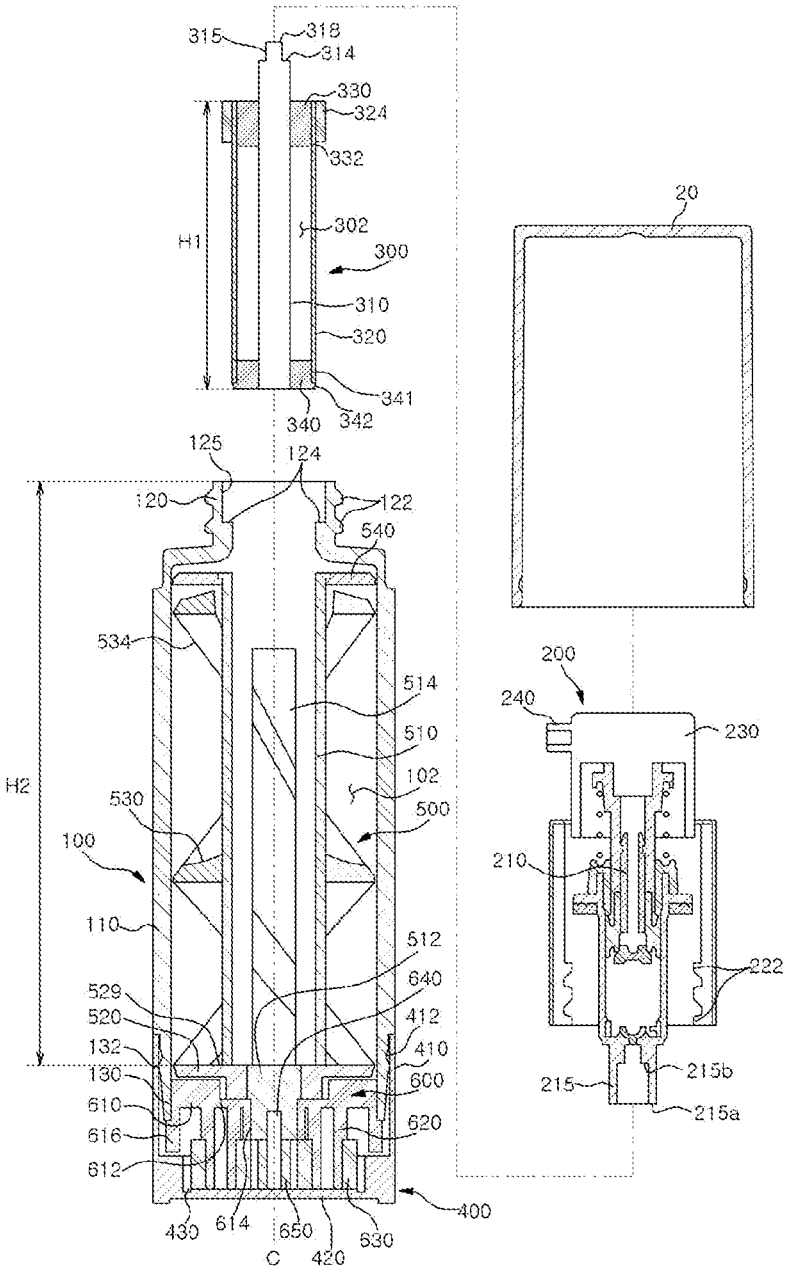

【FIG. 3】
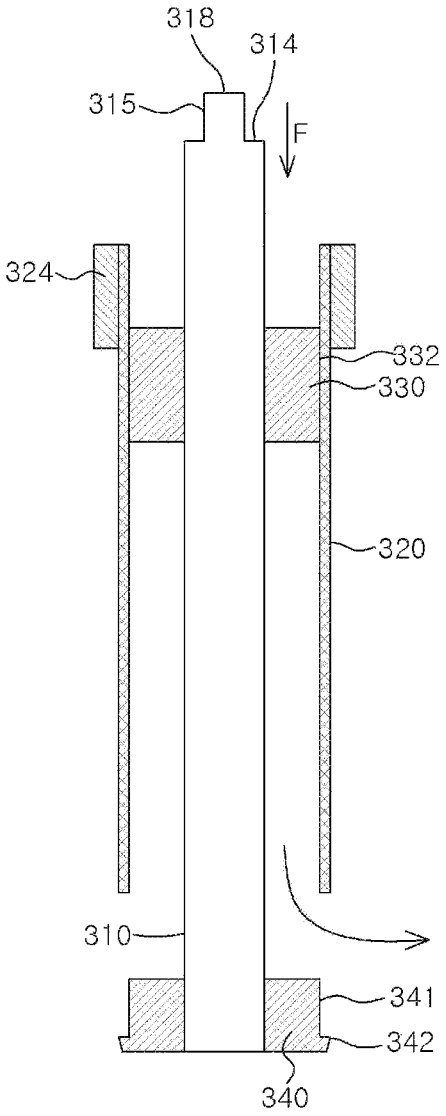

【FIG. 4】
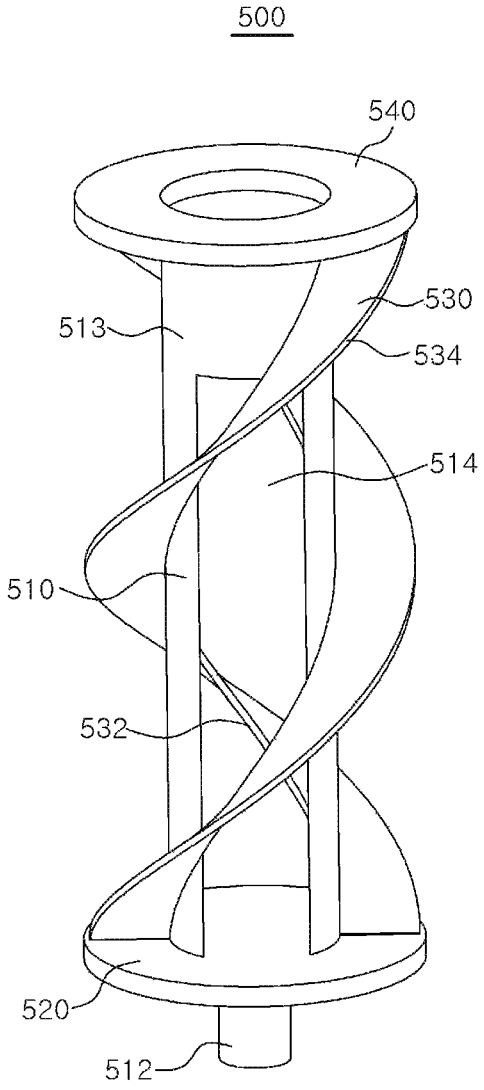

【FIG. 5】
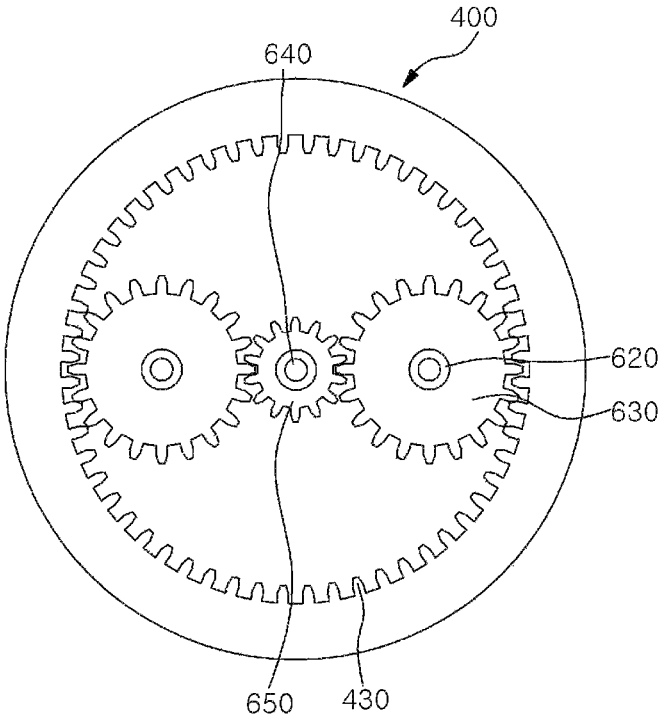

[FIG. 6]
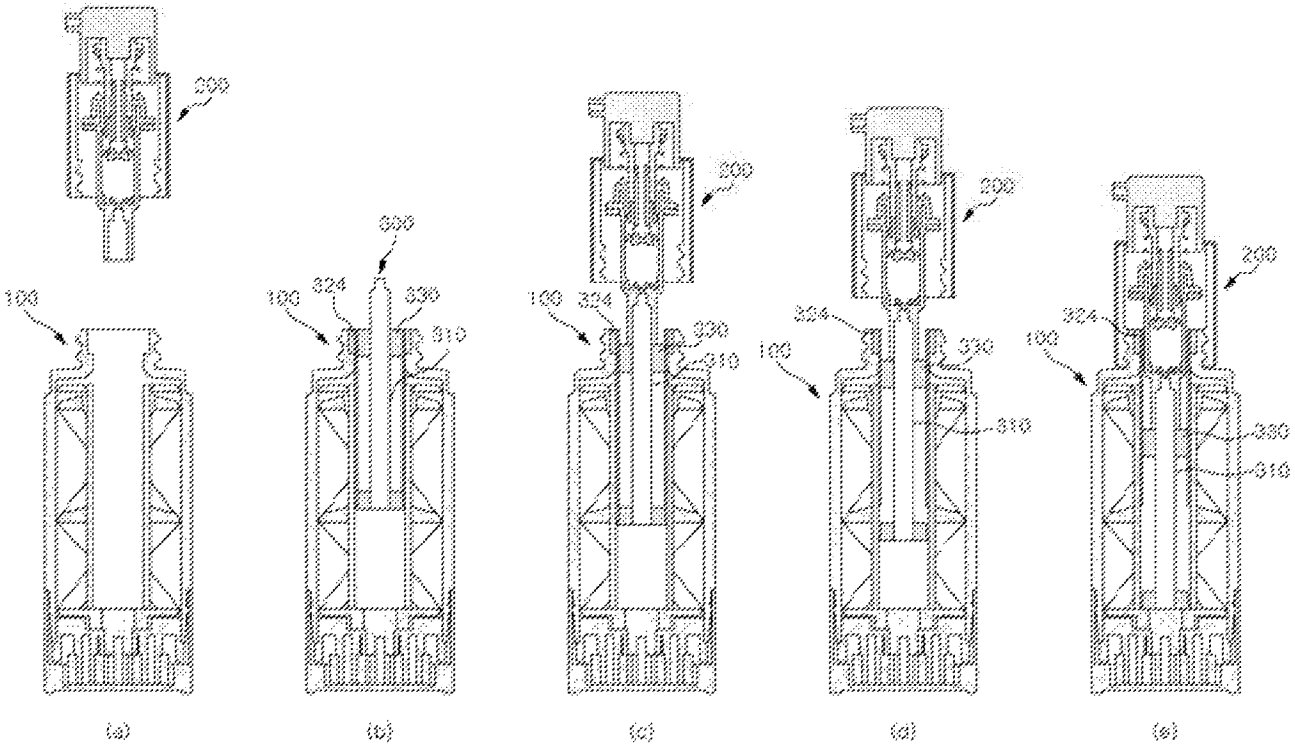

MAIN CONTAINER FOR MIXING COSMETIC, SUB CONTAINER FOR MIXING COSMETIC, AND COSMETIC PRODUCT INCLUDING SAME

TECHNICAL FIELD

The present invention relates to a main container for mixing cosmetic, a sub container for mixing cosmetic and a cosmetic product including the same.

BACKGROUND

Nowadays, cosmetic products are being launched which mix cosmetic raw materials having different properties from each other in order to improve skin care effects. For instance, cosmetic raw materials having different properties from each other have been already mixed in one container, or there is a cosmetic product which stores cosmetic raw materials having different properties from each other in different containers and allows them to be mixed at the time of use by a user.

In a case where a cosmetic product is distributed with cosmetic raw materials of different properties being mixed, there is a concern that due to chemical reaction between cosmetic raw materials, the cosmetic product may not exhibit sufficient skin care effects or its quality may be deteriorated.

Further, in a case where cosmetic raw materials are mixed in advance, there is a concern that raw materials of different densities may not be mixed uniformly. In order to address such problems, various cosmetic products are suggested, whose cosmetics of different properties, or cosmetics of different dosage forms are allowed to be mixed at the time of use. For example, Korean Registered Utility Model No. 20-0464645 suggests a container which can mix cosmetic by rotating a plurality of agitating blades around a rotational axis, which are spaced apart from each other in an up and down direction.

However, such container is directed to the agitation of mixed cosmetics stored in one container, and it does not provide a function of mixing cosmetics which have been separately stored in different containers, respectively.

Further, as the agitating blades are spaced apart from each other in an up and down direction, there exists a region in which cosmetic is indirectly agitated by an influence of surrounding flows without being collided with the agitating blade. Further, it is difficult to form an agitating blade at an upper part and a lower part of the rotational axis, and thus these regions would also become a region where cosmetic is indirectly agitated by an influence of surrounding flows. Accordingly, the contents are difficult to sufficiently agitate in the entire portions, or the agitating blades should rotate more times to achieve the sufficient agitation.

Further, there exists a problem that the cosmetic attached to an inner wall surface of the container is remained thereon without being agitated not only since the agitating blades are arranged as described above, but also since radial ends of the agitating blades are spaced apart from the inner wall surface of the container. Even though containers, which have such function of mixing fluid, are usually made of a transparent material to make the function of mixing fluid appeal to customers, it becomes a negative point for the design due to the fact that cosmetic is attached to the inner wall surface without being mixed. Particularly, if the cosmetic has a high viscosity, such negative point becomes more noticeable.

Further, in the conventional structure, as the agitating blades are fixed to a central rotational axle, it is impossible to apply the agitating blades to a container using a pump, in particular, a container which uses a pump together with a dip tube (a tube extending to near the bottom of the container).

Additionally, in a case where cosmetic raw materials of different properties from each other are stored in respective container, and a user mix them manually at the time of use, there is a concern that inconvenience may be caused. And there is another concern that the cosmetic raw materials of different properties may not be mixed uniformly since a user mix them directly with his or her hands.

PRIOR ART DOCUMENTS

Patent Document

Korean Registered Utility Model No. 20-0464645 (Registered on Jan. 7, 2013)

SUMMARY

Embodiments of the invention are provided in order to address above-mentioned problems, and provide a main container for mixing cosmetic, a sub container for mixing cosmetic and a cosmetic product including them, which enable a user to mix different fluids, which have been stored in respective containers, with a simple manipulation at the time of use.

Further, embodiments of the invention provide a main container for mixing cosmetic, a sub container for mixing cosmetic and a cosmetic product including them which enable a user to select various cosmetic raw materials according to user's preference and mix them.

Further, embodiments of the invention provide a main container for mixing cosmetic, a sub container for mixing cosmetic and a cosmetic product including them which are capable of satisfying customers' desire to use flesh cosmetic products.

Further, embodiments of the invention provide a main container for mixing cosmetic, a sub container for mixing cosmetic and a cosmetic product including them which enable a user to refill a cosmetic raw material with a simple manipulation.

According to an aspect of the present invention, there is provided a cosmetic product, comprising: a first container providing a first storing space which stores a first fluid, and in which fluid can be mixed; a discharging unit which discharges a fluid stored in the first container to the outside; and a second container which can be coupled to the first container, and which can discharge a second fluid stored in the second container to the first storing space, wherein the second container has a storing state in which the second container stores the second fluid and an open state in which the second container can discharge the second fluid, wherein the second container is converted from the storing state to the open state by the discharging unit being coupled to the first container, and wherein, as the second container is converted to the open state, the second fluid is discharged to the first storing space to be mixed with the first fluid.

Further, there is provided a cosmetic product, wherein the second container includes: an outer housing for providing a second storing space which can store the second fluid; an inner housing disposed while being spaced apart from the outer housing; and a first closure which is provided at a lower side of the inner housing to close a lower side of the outer housing, wherein the first closure opens the lower side of the outer housing by the inner housing being pressed by the discharging unit.

Further, there is provided a cosmetic product, wherein the second container includes: an outer housing for providing a second storing space which can store the second fluid; and an inner housing which is provided in the outer housing to be moved relative to the outer housing, wherein a convex part is provided on an outer upper side of the outer housing, on an upper side of the first container is provided a first projected part by which the convex part is caught, the inner housing is moved downward relative to the outer housing by being pressed by the discharging unit while the convex part is caught by the first projected part.

Further, there is provided a cosmetic product, wherein the inner housing includes: a connecting part which is connected to the discharging unit; and a second projected part by which the discharging unit is caught, wherein the first closure opens the lower side of the outer housing by the connecting part and the second projected part being pressed by the discharging unit.

Further, there is provided a cosmetic product, wherein the first fluid and the second fluid which have been mixed in the first storing space are discharged to the outside through a part of the second container.

Further, there is provided a cosmetic product, wherein the inner housing is provided in a shape having an empty interior so as to serve as a dip tube connected to the discharging unit.

Further, there is provided a cosmetic product, wherein the second container includes a second closure which is provided at an upper side of the inner housing to close an upper side of the outer housing.

Further, there is provided a cosmetic product, wherein the second closure is provided so as to be fixed to the inner housing of the second container, and wherein during the conversion of the second container from the storing state to the open state, the second closure slides with respect to the outer housing while being fixed to the inner housing.

Further, there is provided a cosmetic product, wherein the first closure is provided so as to be fixed to the inner housing of the second container, and wherein the first closure is located at a lower side of the first storing space by the discharging unit being coupled to the first container.

Further, there is provided a cosmetic product, wherein the second closure includes an outer surface which is guided by the outer housing, and wherein the inner housing is moved relative and parallel to the outer housing by the outer surface being guided by the outer housing.

Further, there is provided a cosmetic product, wherein the first container and the second container are formed of a transparent material.

Further, there is provided a cosmetic product, wherein the discharging unit includes: a pumping part which generates pressure for pumping a mixed fluid of the first fluid and the second fluid; and a connecting surface which is coupled to the second container, wherein the first fluid and the second fluid which have been mixed in the first storing space are discharged to the outside of the discharging unit by the pressure of the pumping part resulting from a pressing action of a user.

Further, there is provided a cosmetic product, further comprising: a rotating unit which is provided rotatably relative to the first container; and a blade unit which is disposed inside the first container, which is rotated around a rotational axis in a space where the fluid is mixed by the rotation of the rotating unit, and which includes one or more blades extending spirally around the rotational axis from one side to another side of the space, wherein the mixing of the first fluid and the second fluid is prompted by the rotation of the blade unit.

Further, there is provided a cosmetic product, wherein the blade unit includes: a central part which receives a rotating force from the rotating unit to serves as a rotational center; and a second container insertion part which is formed in a shape surrounding the second container, wherein the blade is disposed around the second container insertion part, and wherein when the second container is coupled to the first container, the second container is moved while being guided by the second container insertion part.

Further, there is provided a cosmetic product, wherein the blade unit includes: a first plate which is connected to the central part, and which has a shape of a plate disposed at one side of the first container; and a second plate which is connected to the second container insertion part, and which has a shape of a plate disposed at another side of the first container, wherein one side of the blade is connected to the first plate, and another side of the blade is connected to the second plate, and wherein the blade has a continuous shape between the first plate and the second plate.

Further, there is provided a cosmetic product, further comprising a driving force transferring unit, which is provided at one side of the first container, and which transfers the rotation of the rotating unit to the blade unit.

According to another aspect of the present invention, there is provided a main container for mixing cosmetic, comprising: a first container to which a sub container for mixing cosmetic can be coupled, and which provides a mixing space of cosmetic; and a discharging unit which discharges a fluid stored in the mixing space.

Further, there is provided a main container for mixing cosmetic, further comprising:

a rotating unit which is provided rotatably relative to the first container; and a blade unit which is disposed inside the first container, the blade unit being rotated around a rotational axis in a space where the fluid is mixed by the rotation of the rotating unit, and the blade unit including one or more blades extending spirally around the rotational axis from one side to another side of the space.

According to another aspect of the present invention, there is provided a sub container for mixing cosmetic, comprising: an outer housing which is coupled to a main container for mixing cosmetic which provides a mixing space of cosmetic, and which stores cosmetic; an inner housing which can be moved relative to the outer housing by an external force, and which can serve as a path through which a fluid stored in the mixing space is moved; a first closure which is provided at a lower side of the inner housing to close a lower side of the outer housing; and a second closure which is provided at an upper side of the inner housing to close an upper side of the outer housing, wherein as the inner housing is moved downwards by the external force, the first closure opens the outer housing.

Further, there is provided a sub container for mixing cosmetic, wherein the inner housing is provided in a shape having an empty interior, so as to move a fluid stored in the mixing space by being coupled to the main container for mixing cosmetic.

According to embodiments of the invention, a main container for mixing cosmetic, a sub container for mixing cosmetic and a cosmetic product including the same advantageously enable a user to mix different fluids, which have been stored in respective containers, with a simple manipulation at the time of use.

Further, there is an advantage that a user can select various cosmetic raw materials according to user's preference and then mix them.

Further, there is an advantage that customers' desire to use flesh cosmetic products can be satisfied.

In addition, there is an advantage that with a simple manipulation, a cosmetic raw material can be refilled.

BRIEF DESCRIPTION OF THE DRAWINGS

FIG. 1 is a front view of a cosmetic product according to an embodiment of the present invention.

FIG. 2 is an exploded cross-sectional view before assembly of the cosmetic product of FIG. 1.

FIG. 3 is a cross-sectional view illustrating an open state of a second container of FIG. 1.

FIG. 4 is a perspective view illustrating a blade unit of FIG. 1.

FIG. 5 is a cross-sectional view illustrating an interior of a rotating unit of FIG. 1.

FIG. 6 is diagrams showing an assembly process of a cosmetic product according to the present invention.

DETAILED DESCRIPTION

Hereinafter, specific exemplary embodiments of the present invention will be described in detail with reference to the drawings.

Additionally, it is noted that when describing the present invention, the detailed description for known configurations or functions may be omitted herein so as not to obscure essential points of the invention.

FIG. 1 is a front view of a cosmetic product according to an embodiment of the present invention, FIG. 2 is an exploded cross-sectional view before assembly of the cosmetic product of FIG. 1, FIG. 3 is a cross-sectional view illustrating an open state of a second container of FIG. 1, FIG. 4 is a perspective view illustrating a blade unit of FIG. 1, FIG. 5 is a cross-sectional view illustrating an interior of a rotating unit of FIG. 1, and FIG. 6 is diagrams showing an assembly process of a cosmetic product according to the present invention.

Referring to FIGS. 1 to 6, the cosmetic product 1 according to an embodiment of the present invention may include a first container 100 which stores a first fluid therein, and which provides a space for mixing the first fluid with another fluid; a discharging unit 200 which discharges a fluid stored in the first container 100 to an outside thereof; and a second container 300 which can be coupled to an interior of the first container 100, and which can store a second fluid therein. Further, the second container 300 may be coupled to an inside upper part of the first container 100, and the discharging unit 200 may be coupled at the same time to the first container 100 and the second container 300. At this time, a part of the second container 300 is pressed by the discharging unit 200 to release a closed state of the second container 300, so that the second fluid stored in the second container 300 can be mixed with the first fluid stored in the first container 100. The pressure exerted from the discharging unit 200 as used herein may be understood as a pressure applied downwards during a process where a user assembles the discharging unit 200 to the first container 100.

In addition, the case where the closed state of the second container 300 is released may be understood as an open state thereof, and a case where the closed state of the second container 300 is maintained may be understood as a storing state thereof.

Furthermore, the cosmetic product 1 according to an embodiment of the present invention may further include a means of prompting the mixing of the first fluid stored in the first container 100 and the second fluid stored in the second container 300 after the closed state of the second container 300 is released. Specifically, it may include a rotating unit 400 which is provided relatively rotatably with respect to the first container 100, and the blade unit 500 which is disposed inside the first container 100, which is rotated around a rotational axis C in a first storing space 102 by the rotation of the rotating unit 400, and which includes one or more blades 530 extending spirally around the rotational axis C from one end to the other end of the first storing space 102.

Further, in the present embodiment, the first fluid and the second fluid will be exemplified by cosmetics different from each other. For instance, the first fluid may be a W/O (water/oil) or O/W (oil/water) emulsion, and the second fluid may be a concealer. Such cosmetic prepared by the mixing of the emulsion and the concealer may exhibit various effects according to a mixing rate thereof, so a user can use a customized cosmetic product suitable to herself or himself by mixing the emulsion and the concealer at a rate the user wants. However, the technical idea of the present invention is not limited thereto, and the first fluid may be any fluid which can act as a solvent, while the second fluid mixed to it may be any substance, such as a fluid, powder or the like, which can be mixed to or dissolved in the corresponding fluid. Further, in the embodiment of the present invention, the first container 100, the rotating unit 400, the blade unit 500, a driving force transferring unit 600 to be described later and the discharging unit 200, except the second container 300, may be described as constituting the main container 10 for mixing cosmetic, and the second container 300 may be described as the sub container for mixing cosmetic. That is, the first container 100 and the second container 300 can be coupled to each other, but they may be understood as configurations which can be separately sold for changing or refilling the contents contained in each container.

Further, the main container 10 for mixing cosmetic may be coupled to a lid 20 so as to be produced and sold as a single cosmetic product. Hereinafter, for convenience of description, a direction in which the lid 20 is provided is referred to as an upper side, and a direction in which the rotating unit 400 is provided is referred to as a bottom side.

The lid 20 can cover the discharging unit 200 so as for the discharging unit not to be exposed to outside when the cosmetic product 1 is not used, and can be removably press-fitted to an end of the discharging unit 200 of the first container 100.

Further, the first fluid stored in the main container 10 for mixing cosmetic and the second fluid stored in the second container 300 may be separately sold, and be used by mixing the second fluid contained in the second container 300 with the first fluid stored in the main container 10 for mixing cosmetic according to user's preference.

The first container 100 may be formed of transparent material, so that it can be confirmed from outside that a fluid in the first container 100 is mixed. In this case, a user can confirm with the naked eye that different fluids (cosmetics) from each other are mixed to make a new form of a fluid (cosmetic), so reliability for the product can be improved exhibiting an aesthetic effect.

The first container 100 may include a tube part 110 which may be provided with both ends open, and which substantially provides a storing space for a fluid and a mixed fluid, a neck part 120 which is provided at one end of the tube part 110, and to which the discharging unit 200 and the second container 300 are coupled, and a coupling part 130 which is provided at the other end of the tube part 110, and to which the rotating unit 400 is coupled.

However, according to an embodiment of the present invention, only the first container 100, the second container 300, and the discharging unit 200 may be provided excluding the rotating unit 400 and the blade unit 500, and in this case, the first container 100 may be configured to have a closed lower side.

A first storing space 102 formed by the tube part 110 may be cylindrical, and cosmetic attached to an inner wall surface of the tube part 110 may be detached therefrom by rotation of the blade unit 500. However, the technical idea of the present invention is not limited thereto, and as an example, in the case of an embodiment where the blade unit 500 does not contact the inner wall surface of the tube part 110, the first storing space 102 may not be cylindrical. Also, the outer shape of the tube part 110 does not limit the technical idea of the present invention. In the present embodiment, the tube part 110 is shown by way of example as being generally cylindrical.

The tube part 110 may be provided in a cylindrical shape whose cross sectional area changes along a direction in which the rotational axis C of the blade unit 500 extends. In this case, the configuration of the blade 530 may be changed corresponding to the change in an inner diameter of the tube part 110. For example, the width of the blade 530 may be changed corresponding to the change in the inner diameter of the tube part 110. Further, the blade 530 may be kept in contact with the inner wall surface of the tube part 110 entirely along the extension direction of the tube part 110.

Further, on an upper end of the tube part 110, a coupling portion to which the lid 20 is coupled may be provided.

The neck part 120 may be formed to have a diameter relatively less than that of the tube part 110, and may have a shape for being coupled to the discharging unit 200 and the second container 300. Specifically, on an outer circumference of the neck part 120, screw threads 122 are formed, so that the discharging unit 200 can be coupled to the neck part 120 of the first container 100. At this time, also on an inner circumference of the discharging unit 200, screw threads 222 corresponding to the screw threads 122 of the neck part 120 may be formed.

Further, on an inner side of the neck part 120, a first projected part 124 by which the second container 300 can be supported, may be formed. That is, a convex part 324 formed on an upper side of the second container 300 to be described later can be caught by the first projected part 124 of the neck part 120.

After the convex part 324 of the second container 300 is caught by the first projected part 124 of the first container 100 (the second container 300 is supported by the first container 100), an upper side (second projected part 314) of the second container 300 is subject to a downward force from the discharging unit 200, so that the closed state of the second fluid stored in the second container 300 can be released. In this case, the second fluid stored in the second container 300 can flow into the first container 100, which will be described in detail later.

Further, the neck part 120 may include a projected part upper surface 125 corresponding to an outer diameter of the convex part 324, so that the convex part 324 of the second container 300 can be fitted into the projected part upper surface 125.

The coupling part 130, which supports the rotating unit 400, may be a cylinder shape inserted into the rotating unit 400. Further, the coupling part 130 may have an aperture shape into which the driving force transferring unit 600 can be inserted. On a circumference of the coupling part 130, there may be formed an inner projected part 132 which fixes the rotating unit 400 and at the same time rotatably supports the rotating unit 400.

The discharging unit 200, which is a means of discharging a mixed fluid or a fluid stored in the first container 100, may be embodied with various types of discharging means. The discharging unit 200 may include a pumping part 210 which generates a pressure for pumping a fluid, a pressing part 230 which applies a pressure resulting from a pressing action of a user to the pumping part 210, and a nozzle part 240 which discharges a fluid to the outside. Herein, the detailed description on the configuration and operation of the pumping part 210, the pressing part 230 and the nozzle part 240 will be omitted.

Further, the discharging unit 200 may include a structure for releasing the closed state of the second container 300 by pressing the second container 300 by means of an outer force. Specifically, the discharging unit 200 may include a connecting surface 215 formed at a lower side of the discharging unit 200. The connecting surface 215 may include a first surface **215*a* which is caught by a second projected part 314 of an inner housing 310 to be described later, and a second surface 215*b* which is caught by an end part 318 of the inner housing 310 (see FIGS. 2 and 3**).

However, it is not limited thereto, and the first surface **215*a* of the connecting surface 215 may disposed such that it is supported by an upper side of a second closure 330. In this case, the first surface 215*a* presses the upper side of the second closure 330, and the second surface 215*b* may be configured to be caught by the second projected part 314 and press the second projected part 314 (see FIGS. 2 and 3**).

The second container 300 may provide a second storing space 302 which can store the second fluid. The second container 300 may be provided with an outer housing 320, the inner housing 310 spaced apart from the outer housing 320 by a predetermined distance, and a first closure 340 which closes lower sides of the outer housing 320 and the inner housing 310.

Further, the second container 300 may further include the second closure 330 which closes the upper side of the outer housing 320 and the inner housing 310.

Further, the second container 300 may be formed of transparent material, so that a user can confirm from the outside that a fluid is mixed.

An up and down direction height H1 of the second container 300 may be half of an up and down direction length H2 of the inside of the first container 100. In this case, when the second closure 330 is moved downwards in the first storing space 102, the second closure 330 can sweep a part of the outer housing 320, and the first closure 340 is spaced apart from the lower part of the first storing space 102 by a length of the outer housing 320 swept by the second closure 330.

Further, a bottom 529 of a first plate 520 may be further provided with a groove (not shown) that is formed on an area which the inner housing 310 contacts. Through this groove, the fluid can easily move from the storing space 102 of the first container 100 to the inner housing 310. Herein, the up and down direction length H1 of the second container 300 may be understood as a length from an upper surface of the second closure 330 to a lower surface of the first closure 340, and the up and down direction length H2 of the first container 100 may be understood as a length from the bottom 529 of the first plate 520 to an upper side of the first container 100.

Meanwhile, the inner housing 310 may serve as a path through which the mixed fluid (mixing between the first fluid and the second fluid) in the first container 100 can be moved and discharged to the outside.

Further, the up and down direction length H1 of the second container 300 may be formed less than half of the up and down length H2 inside the first container 100 by 0.5 mm to 1 mm. Even in this case, when the discharging unit 200 has been coupled to the first container 100, the inner housing 310 of the second container 300 may be spaced apart from the bottom 529 of the first plate 520. In addition, through a gap formed between a bottom of the second container 300 and the inner housing 310, a fluid may be moved from the first storing space 102 to the inner housing 310. As the convex part 324 is formed on an upper outer side of the outer housing 320, the convex part 324 is coupled to the first projected part 124 of the first container 100 when the second container 300 and the first container 100 are coupled to each other. At this time, the convex part 324 of the second container 300 may be fitted into the neck part 120 of the first container 100. Further, the outer housing 320 may have a shape corresponding to a second container insertion part 510 of the blade unit 500 to be described later. For instance, if the second container insertion part 510 has a cylinder shape, the outer housing 320 may have a cylinder shape. However, the shape is not limited thereto.

The interior of inner housing 310 is empty, and the inner housing 310 may serve as a dip tube. Further, the upper part of the inner housing 310 may be coupled with the discharging unit 200. Additionally, the mixed fluid contained in the first container 100 may be discharged to the outside through the inner housing 310 by the pumping of the discharging unit 200. As described above, the inner housing 310 serves as a dip tube, the inner space of the first container 100 can be utilized efficiently. Herein, the inner housing 310 may have a cylinder shape, but its shape is not limited thereto.

The upper side of the inner housing 310 may be provided with a means for coupling to the discharging unit 200. For instance, the upper side of the inner housing 310 may be provided with the connecting part 315 which has a circumference outer diameter less than that of the inner housing 310. Further, the inner housing 310 may include the second projected part 314 due to the difference in diameter between the connecting part 315 and the inner housing 310. As such, the upper side of the inner housing 310 may be fitted into the lower side of the discharging unit 200. However, the means of coupling the inner housing 310 to the discharging unit 200 is not limited to the fitting, and a screw thread may be formed on the upper side of the inner housing 310 to become a means of coupling to the lower side of the discharging unit 200. Further, the connecting part 315 may include the end part 318, so that it can be caught by the second surface 215*b* of the discharging unit 200.

The first closure 340 may be fixed at the lower side of the inner housing 310 to close the lower side of the outer housing 320.

Further, when the inner housing 310 is pressed by the discharging unit 200, the first closure 340 may be moved downwards in the first storing space 102 while releasing a coupled state with the outer housing 320.

The first closure 340 may be provided with a hole (now shown) through which the inner housing 310 can penetrate, and the inner housing 310 whose interior is empty may discharge the mixed fluid contained in the first storing space 102 to the outside of the discharging unit 200 through the hole.

The second closure 330 connects the upper side of the outer housing 320 and the inner housing 310. The second closure 330 has a shape surrounding one side of the circumference of the inner housing 310.

The second closure 330 is fixed to the inner housing 310, but is not fixed to the outer housing 320. That is, when the inner housing 310 is moved downwards by the pressure from the lower side of the discharging unit 200, the second closure 330 is also moved at the same time together with the inner housing 310. At this time, the second closure 330 may be configured to move slidably with respect to the outer housing 320.

In addition, an outer surface 332 of the second closure 330 is guided by the outer housing 320, so it may move such that the inner housing 310 and the outer housing 320 are parallel to each other.

Further, the second closure 330 may also be provided with a hole (not shown) through which the inner housing 310 penetrates.

Herein, the longer an up and down direction length of the outer surface 332 is, the more parallel the inner housing 310 can move to the outer housing 320.

The blade unit 500 may function to mix the first fluid and the second fluid within the first storing space 102 while rotating inside the first container 100. Further, the blade unit 500 may be provided with one or more blades 530 which provide a mixing force that enables the first fluid and the second fluid to flow or mixes them by directly colliding against them.

The blade 530 may be disposed so as to rotate around the rotational axis C within the storing space 102. Herein, the rotational axis C may be an imaginary line generated by extending a central line of a rotational axle 640 which rotates the blade unit 500, and may be provided in a form extending in an up and down direction of the first container 100. Herein, the blade 530 is configured to surround the second container 300, so that two configurations can be arranged so as not to interfere each other.

In the present embodiment, two blades 530 are shown by way of example as being spirally formed in an up and down direction. Herein, one blade 530 may be formed to extend from a lower end to an upper end while being wound once around the rotational axis C. That is, when viewed from the top, start and end points of one blade 530 may be disposed at the same point.

Further, a plurality of blades 530 may extend symmetrically around the rotational axis C. With such configuration, fluid mixing can be uniformly performed within the storing space 102.

The blade 530 may be supported by the first plate 520 and a second plate 540 which are rotated by the rotating unit 400.

Herein, the second plate 540 may be spaced apart from the first plate 520 by a predetermined distance while facing the first plate 520. Further, the second plate 540 may be optionally provided, but preferably it is provided for robust support of the blade 530. The first plate 520 and the second plate 540 will be described in detail later.

The blade unit 500 may include a central part 512 which receives a rotating force of the rotating unit 400, and which serves as a rotational center, and the second container insertion part 510 surrounding the second container 300.

The inner circumferential surface of the second container insertion part 510 may serve as a guide when the second container 300 is inserted into the first container 100. Specifically, the outer housing 320 of the second container 300 may be guided by the second container insertion part 510. Further, when the inner housing 310 is moved down toward the lower side of the first container 100, a part of the outer circumference of the first closure 340 (a lower circumferential surface 342) may be guided by the inner circumference of the second container insertion part 510. Herein, the first closure 340 may include an upper circumferential surface 341 which is fitted into the inner circumference of the outer housing 320, and the lower circumferential surface 342 which has an outer diameter greater than that of the upper circumferential surface 341. Herein, the outer diameter of the lower circumferential surface 342 may be equal to that of the outer housing 320.

Further, the blade 530 is disposed on the circumference of the second container insertion part 510.

The central part 512, which is a rotational center of the blade unit 500, is rotated while being fixed to the rotational axle 640 to which the rotating force is transferred from the rotating unit 400. The central part 512 may be provided on a side opposite to the discharging unit 200, that is, on a side where the rotating unit 400 of the first container 100 is disposed. The second container insertion part 510 may have a shape extending from the central part 512 to the discharging unit 200.

The second container insertion part 510 may be provided so as to rotate together with the central part 512 while at the same time providing a space into which the second container 300 can be fitted. Herein, it may be provided such that the inner circumferential surface of the second container insertion part 510 does not contact the second container 300. With such configuration, the blade unit 500 can rotate without influence on the inner housing 310 which serves as a dip tube.

Meanwhile, a part of the outer side of the second container insertion part 510 may be provided with an opening. For example, the second container insertion part 510 may include a cutaway portion 514. The cutaway portion 514 may be formed plural in number in a shape of a rectangle. Further, the cutaway portion 514 may be formed in a circumferential direction of the second container insertion part 510 at a certain interval.

As described above, the second container insertion part 510 includes the cutaway portion 514, and thus the second fluid can flow into the first container 100 through the cutaway portion 514 from the second container 300 after the closed state of the second container 300 has been released.

Further, at least a part 513 of the second container insertion part 510 may be formed to completely surround the second container 300 to ensure a stable support of the second container.

The lower end of the part 513 of the second container 300 may be located so as to correspond to the lower end of the outer housing 320 when the second container 300 is caught by the first container. In this case, the cutaway portion 514 may begin at a section where the second fluid starts to escape from the second container 300.

Further, the blade unit 500 may include the first plate 520 which is connected to the central part 512 so as to be disposed at one side of the storing space 102, and which has a plate shape, and the second plate 540 which is connected to the second container insertion part 510 so as to be disposed at the other side of the storing space 102, and which has a plate shape. And one side of the blade 530 may be connected to the first plate 520, while the other side thereof may be connected to the second plate 540.

Specifically, the first plate 520 may be formed in a shape of a plate which is disposed adjacent to the rotating unit 400 while traversing the storing space 102, and a pair of the blades 530 may be disposed symmetrically on one side and the other side of the first plate 520. The plurality of blades 530 may extend symmetrically around the rotational axis C from the first plate 520 to the second plate 540.

At this time, the blade 530 may be continuously formed between the first plate 520 and the second plate 540. As described above, the blade 530 enables the fluid to be agitated entirely within an up and down direction section of the storing space 102 in which the blade is formed, while at the same time the blade 530 can generate a continuous spiral flow of a fluid.

The first plate 520 may be rotated while being seated on a base 610 to be described later, which constitutes the one side surface of the storing space 102. The second plate 540 may be provided adjacent to the neck part 120, that is, a mouth of the storing space 102. As an example, a distance between the second plate 540 and a point where the neck part 120 is connected to the tube part 110 may be within 10% of the total length of the storing space 102. In this case, the blade unit 500 may be formed over a section corresponding to 90% of the storing space 102, so the blade unit 500 can agitate a fluid within the entire storing space 102. Therefore, a rapid fluid agitation becomes possible.

In this embodiment, the blade 530 of the blade unit 500 may be formed over 50% or more of the total length of the storing space 102 for the entire fluid agitation. Further, the position of the first plate 520 is not limited to a case where it is seated on the base 610, and it may be disposed at any position within the storing space 102 to support the blade 530.

The blade 530, which may be provided in a shape of a blade having a predetermined width, may generate a flow by colliding against a fluid or pushing a fluid between the first plate 520 and the second plate 540. At this time, an inner edge 532 of the blade 530 may be spaced apart from the second container insertion part 510. Further, at least a part of an outer edge 534 of the blade 530 may contact the inner wall surface of the first container 100 and move slidably with respect to it.

Further, the inner edge 532 of the blade 530 may contact the second container insertion part 510, and the outer edge 534 of the blade may contact the inner wall surface of the tube part 110. In this case, the blade 530 may have stronger structure, and the fluid may be irregularly moved in an up and down direction. However, the technical idea of the present invention is not limited to this. For example, the inner edge 532 of the blade 530 may be spaced apart from the second container insertion part 510, and the outer edge 534 of the blade 530 may be spaced apart from the inner wall surface of the tube part 110.

According to an embodiment of the invention, the inner edge 532 of the blade 530 may be spaced apart from the second container insertion part 510. In this case, the fluid flow by the blade 530 may be generated in an up and down direction within a space between the inner edge 532 and the second container insertion part 510.

Further, the outer edge 534 of the blade 530 may sweep off a fluid (or other substance) attached to the inner wall surface of the first container 100, so that the inner wall surface of the first container 100 can be maintained clear. Thereby the esthetic sense may be provided to a user. The blade 530 may be formed of a material whose strength is less than that of the first container 100, so that the blade can be prevented from scratching the first container 100. For example, the storage container 100 may be formed of transparent PETG, and the blade 530 may be formed of polypropylene.

Meanwhile, as another embodiment, the outer edge 534 of the blade 530 may contact the inner wall surface of the first container 100, and be formed of a soft material. In this case, the blade 530 may be in a shape of a wiper which sweeps off the inner wall surface of the first container 100. The blade 530 having a shape of a wiper may move slidably on the inner wall surface of the first container 100, and be formed of a low friction material, such as Teflon, in order to minimize damage on the inner wall surface.

In the present embodiment, the outer edge 534 is described by way of example as contacting the inner wall surface of the first container 100, but the technical idea of the invention is not limited thereto. For example, the outer edge 534 may be disposed so as to be spaced apart from the inner wall surface of the first container 100. That is, the width of the blade 530 may be set such that the blade 530 can rotate while being spaced apart from the inner wall surface of the first container 100. At this time, the distance between the outer edge 534 of the blade 530 and the inner wall surface of the first container 100 may be set such that the fluid flow can generate pressure enough to detach the fluid and other substance from the inner wall surface of the first container 100. For example, the distance between the outer edge 534 of the blade 530 and the inner wall surface of the first container 100 may be set to be 1 mm or less.

Further, according to properties of fluids to be mixed, the first fluid, the second fluid and mixture thereof may not be attached to the inner wall surface of the first container 100. In a case where the property of the fluid is like that, the outer edge 534 of the blade 530 may be designed to be sufficiently spaced apart from the inner wall surface of the first container 100. In this case, fluid flow may be generated in an up and down direction between the outer edge 534 and the inner wall surface of the first container 100, so that the fluid can be mixed more smoothly.

Meanwhile, the second container insertion part 510, which may serve to connect the first plate 520 with the second plate 540, may serve as a rotational axle of the blade unit 500. Therefore, the second container insertion part 510 may be referred to as a rotational axle part.

Meanwhile, on one side of the first container 100, the driving force transferring unit 600 may be provided for transferring the rotation of the rotating unit 400 to the blade unit 500. In this embodiment, the driving force transferring unit 600 is described by way of example as providing a predetermined gear assembly, but the technical idea of the invention is not limited to this, and various known rotating force transferring devices, such as a belt, a chain, a roller and the like, may be used.

Specifically, the driving force transferring unit 600 may include the base 610 which is coupled to one side of the first container 100 so as to close one-side opening of the first container 100, and the blade unit 500 may be rotatably coupled to the base 610. The base 610 may have such a configuration and an area that it can be inserted into the coupling part 130 to close the open space. That is, the one side of the first container 100 may be closed by the base 610, and thereby the storing space 102 can be formed.

On an upper surface of the base 610, a rotation supporting part 612 may be formed for slidably and rotatably supporting a part of the bottom surface of the first plate 520. As an example, the rotation supporting part 612 may be a groove into which a protruding region formed on the bottom surface of the first plate 520 may be inserted.

In a central portion of the base 610, more specifically, a central portion of the rotation supporting part 612, a through hole 614 may be formed into which the central part 512 of the blade unit 500 may be inserted. The central part 512 may be connected to the rotational axle 640 through the through hole 614. That is, the blade 500 may be rotatably coupled to the base 610. The rotational axle 640 may extend downwards from the central part 512, and be located between the rotating unit 400 and the base 610.

Further, on a circumference of the base 610, a receiving portion 616 may be provided on which the coupling part 130 may be seated and supported. The receiving portion 616 may support the end of the coupling part 130 while pressing it. Further, the rotating unit 400 may be coupled to the coupling part 130, and press a connecting gear rotational axle 620 formed on the base 610.

The rotating unit 400 may surround the base 610 and the coupling part 130, and be relatively rotatably coupled to the coupling part 130. A user may rotate the blade unit 500 by relatively rotating the rotating unit 400 with respect to the first container 100, and by such action, the first fluid and the second fluid may be mixed.

Specifically, the rotating unit 400 may include a housing part 410 which surrounds the coupling part 130, and a bottom part 420 which forms a bottom surface of the main body 10. At this time, on an outer circumferential surface of the coupling part 130, an inner projected part 132 may be formed, and on an inner circumferential surface of the housing part 410, an outer projected part 412 may be formed. The outer projected part 412 is caught by the inner projected part 132, so that the rotating unit 400 can be fixed to the first container 100.

The outer projected part 412 of the rotating unit 400 may slide along the inner projected part 132. Further, the rotating unit 400 may be relatively rotated with respect to the first container 100. The inner projected part 132 and the outer projected part 412 may be protrusions projected in a ring shape, respectively. By pressing the rotating unit 400 toward the first container 100, the coupling part 130 and the housing part 410 may be elastically deformed to a certain extent, so that the outer projected part 412 can move over the inner projected part 132 to be caught by the inner projected part 132. As a result, the rotating unit 400 may be fixed to the first container 100. In this case, the outer projected part 412 may be brought into contact with and slid on the inner projected part 132. Further, the rotating unit 400 may be relatively rotated with respect to the first container 100 at a predetermined position.

Meanwhile, the bottom part 420 may press the connecting gear rotational axle 620 formed on the base 610. Therefore, the base 610 may be pressed upwards, and then it may press the end of the coupling part 130. As a result, the base 610 may be firmly maintained at a position where it is inserted into the coupling part 130. In the present embodiment, the base 610 is described by way of example as being fixed by being pressed by the coupling part 130 and the rotating unit 400, but the base 610 may be adhesively fixed or press-fit fixed to the coupling part 130.

On the base 610, the rotational axle 640, which becomes a rotational center of the blade unit 500, and a center gear 650 coupled to the rotational axle 640 may be provided. Inside the rotating unit 400, a main gear 430 may be formed along an inner circumferential surface of the rotating unit 400. Further, in the base 610, at least one connecting gear 630 may be provided which transfers rotating force of the main gear 430 to the center gear 650.

As described above, the rotational axle 640 may be fixed to the central part 512 extending through the base 610, and the center gear 650 may rotate the rotational axle 640 by means of the rotation of the main gear 430.

The connecting gear 630 may be fixed to the connecting gear rotational axle 620 extending downward from the base 610, and may be provided plural in number around the center gear 650. This connecting gear 630 may serve to transfer the rotating force of the main gear 430 to the center gear 650. At this time, the main gear 430, the connecting gear 630 and the center gear 650 may be formed with a gear ratio such that the rotational axle 640 can have a rotation number greater than that of the rotation unit 400. That is, the center gear 650 may rotate more than one time for one rotation of the rotating unit 400, and thereby the blade unit 500 may rotate more times than the rotation unit 400. As a result, even though a user exerts a small amount of force to the rotating unit 400, the fluid can be easily mixed. In the present embodiment, the connecting gear 630 is shown by way of example as being provided in a pair at both sides of the center gear 650, but the invention is not limited to this.

Hereinafter, operation and effect of the cosmetic product 1 according to an embodiment having a configuration as described above will be described (see FIG. 6).

First, the first container 100, the second container 300 and the discharging unit 200 are coupled to each other as below.

Referring to FIG. 6, (a) shows the discharging unit 200 and the first container 100 except the second container 300, (b) shows that the second container 300 is coupled to the upper side of the first container 100, (c) shows that the inner housing 310 is about to be pressed after the lower side of the discharging unit 200 is coupled to the second container 300, (d) shows that the lower side of the discharging unit 200 presses the second container 300, and thus the inner housing 310 is moved to the lower side of the first container 100, and (e) shows that the discharging unit 200 is coupled to the first container 100, and the inner housing 310 of the second container 300 is moved to the lower side of the first container 100. In (e) of FIG. 6, when the inner housing 310 of the outer housing 300 has been moved, the inner housing 310 may be disposed while being spaced apart from the first plate 520.

Through these processes, the second fluid stored in the second container 300 may be mixed with the first fluid stored in the first container 100.

Further, after the first container 100, the discharging unit 200 and the second container 300 have been coupled to each other completely, the rotation of the blade unit 500 may prompt the mixing between the first fluid and the second fluid.

Further, the main container 10 for mixing cosmetic is assembled as below. First, the blade unit 500 is coupled to the driving force transferring unit 600. At this time, the center part 512 of the blade unit 500 may be inserted into the through hole 614 from the one side of the base 610, and the rotational axle 640 may be coupled and fixed to the center part 512. The center gear 650 may be coupled to the rotational axle 640. The blade unit 500 may be rotatably fixed to the base 610 by the center gear 650 being coupled to the rotational axle 640.

After that, the connecting gear 630 may be inserted onto the connecting gear rotational axle 620 of the base 610 so as to operate with the center gear 650.

An assembler may put the assembly of the blade unit 500 and the driving force transferring unit 600 into the first storing space 102 of the first container 100 through the coupling part 130. At this time, the insertion depth of the assembly may be limited by the receiving portion 616 formed on the base 610 being caught by the end of the coupling part 130. The base 610 may close the one side of the storing space 102 by being inserted into the coupling part 130.

After that, the assembler may fit the coupling part 130 into the rotating unit 400. At this time, the outer projected part 412 may be caught by the inner projected part 132, and thereby the rotating unit 400 may be relatively rotatably fixed to the first container 100. Besides, the main gear 430 formed on the inner circumferential surface of the rotating unit 400 may be disposed so as to operate with the connecting gear 630 and the center gear 650.

At this state, the first fluid may be injected into the first container 100 through the neck part 120, and then the discharging unit 200 may be coupled to the first container 100 and the second container 300 as described above.

The user may buy the main container 10 for mixing cosmetic and the second container 300 separately, and then, for their use, combine the second container 300 with the main container 10 for mixing cosmetic.

The user may close the first container 100 by combining the discharging unit 200 with the first container 100 and the second container 300. Then, the first container 100 and the rotating unit 400 may be rotated relative to each other. For example, the user may rotate the rotating unit 400 with one hand while fixing the first container 100 with the other hand.

At this time, the main gear 430, the connecting gear 630 and the center gear 650 are operated together, so that the user may rotate the blade unit 500 at a rotation number greater than that of the rotating unit 400.

As the inner housing 310 of the second container 300 is disposed inside the second container insertion part 510, it can maintain its position stably regardless of the rotation of the blade unit 500.

The blade 530 formed in the blade unit 500 has a shape extending continuously and spirally from one side to the other side of the first container 100 in an extension direction of the first container 100. Thereby the blade 530 can agitate the entire fluid contained in the first container 100.

In a case where the first plate 520 constituting the one-side end of the blade 530 is supported by the base 610, the second plate 540 is disposed adjacent to the neck part 120, and the blade 530 is formed over the entire length of the first storing space 102, the effect of agitation may be maximized.

Further, the outer edge 534 of the blade 530 may rotate in contact with the inner wall surface of the first container 100, so that the fluid can be prevented from being attached to the inner wall surface of the first container 100.

Further, in a case where the inner edge 532 of the blade 530 is spaced apart from the second container insertion part 510, the fluid flow can be generated in an up and down direction by the blade 530, so that the agitation performance can be improved. Particularly, when the outer edge 534 is in contact with the inner wall surface of the first container 100, the space between the inner edge 532 and the second container insertion part 510 may serve as a path through which the fluid can be mixed in an up and down direction. When the fluid flow formed spirally by the blade 530 and the fluid flow formed in an up and down direction in the space between the inner edge 532 and the second container insertion part 510 are mixed with each other, more effective fluid agitation can take place. The cosmetic product 1 according to an embodiment of the invention can mix a fluid sufficiently with a less rotation number of the blade unit 500 since the blade unit 500 is formed continuously along the extension direction of the rotational axis and over its entire length.

Further, the blade unit 500 can prevent a fluid or other substance from being remained on the inner wall surface of the first container 100, the first container 100 can be always kept clean.

Further, the inner housing 310 of the second container 300 may be disposed inside the second container insertion part 510 which serves as the rotational axis, so that it can serve as a dip tube. In this case, the fluid may be discharged to the outside from the hollow space of the inner housing 310 through the discharging unit 200.

Further, according to another embodiment of the invention, the blade unit 500 may be provided with two blades which are formed spirally in an up and down direction, and one of which extends from the lower end to the upper end while being wound half around the rotational axis C. That is, when viewed from the top, the start point and the end point of one blade are disposed symmetrically with respect to the central axis.

Further, according to still another embodiment of the invention, the blade unit 500 may be provided with four blades which are formed spirally in an up and down direction, and one of which extends from the lower end to the upper end while being wound half around the rotational axis C. At this time, the blade of the blade unit 500 may be formed with a width less than that of above-described embodiments, so that the outer edge can be spaced apart from the inner wall surface of the first container 100.

Further, the multiplication of the rotation number at which the blade 530 is wound around the rotational axis C and the number of the blades 530 may be equal to or greater than 1. Thereby, force of agitating a fluid may be provided greater than a certain level.

While the cosmetic product according to embodiments of the invention are described as concrete embodiments, these are just exemplary embodiments, and the present invention should be construed in a broadest scope based on the fundamental technical ideas disclosed herein, rather than being limited to them. By combining or replacing a part or parts of embodiments disclosed herein, the ordinary skilled in the art may carry out a type of form which is not explicitly described herein, and however, it should be noted that it shall not depart from the scope of the present invention. Besides, the ordinary skilled in the art may easily change or modify embodiments disclosed herein based on the invention, and however, it is obvious that such change or modification also falls within the scope of the present invention.

[Reference Signs List]

| | |
|---|---|
| 1: cosmetic product | 10: main container for mixing cosmetic |
| 100: first container | 200: discharging unit |
| 300: second container | 400: rotating unit |
| 500: blade unit | |

What is claimed is:

1. A cosmetic product, comprising:

a first container providing a first storing space which stores a first fluid, and in which fluid can be mixed;

a discharging unit which discharges a fluid stored in the first container to the outside; and a second container which can be coupled to the first container, and which can discharge a second fluid stored in the second container to the first storing space;

a rotating unit which is provided rotatably relative to the first container; and a blade unit which is disposed inside the first container, which includes one or more blades rotating by the rotation of the rotating unit, wherein the second container has a storing state in which the second container stores the second fluid and an open state in which the second container can discharge the second fluid, wherein the second container is converted from the storing state to the open state by the discharging unit being coupled to the first container, and wherein, as the second container is converted to the open state, the second fluid is discharged to the first storing space to be mixed with the first fluid.

2. The cosmetic product of claim 1, wherein the second container includes:

an outer housing for providing a second storing space which can store the second fluid;

an inner housing disposed while being spaced apart from the outer housing; and a first closure which is provided at a lower side of the inner housing to close a lower side of the outer housing, wherein the first closure opens the lower side of the outer housing by the inner housing being pressed by the discharging unit.

3. The cosmetic product of claim 1, wherein the second container includes:

an outer housing for providing a second storing space which can store the second fluid; and an inner housing which is provided in the outer housing to be moved relative to the outer housing, wherein a convex part is provided on an outer upper side of the outer housing, on an upper side of the first container is provided a first projected part by which the convex part is caught, the inner housing is moved downward relative to the outer housing by being pressed by the discharging unit while the convex part is caught by the first projected part.

4. The cosmetic product of claim 2, wherein the inner housing includes:

a connecting part which is connected to the discharging unit; and a second projected part by which the discharging unit is caught, wherein the first closure opens the lower side of the outer housing by the connecting part and the second projected part being pressed by the discharging unit.

5. The cosmetic product of claim 1, wherein the first fluid and the second fluid which have been mixed in the first storing space are discharged to the outside through a part of the second container.

6. The cosmetic product of claim 2, wherein the inner housing is provided in a shape having an empty interior so as to serve as a dip tube connected to the discharging unit.

7. The cosmetic product of claim 2, wherein the second container includes a second closure which is provided at an upper side of the inner housing to close an upper side of the outer housing.

8. The cosmetic product of claim 7, wherein the second closure is provided so as to be fixed to the inner housing of the second container, and wherein during the conversion of the second container from the storing state to the open state, the second closure slides with respect to the outer housing while being fixed to the inner housing.

9. The cosmetic product of claim 2, wherein the first closure is provided so as to be fixed to the inner housing of the second container, and wherein the first closure is located at a lower side of the first storing space by the discharging unit being coupled to the first container.

10. The cosmetic product of claim 7, wherein the second closure includes an outer surface which is guided by the outer housing, and wherein the inner housing is moved relative and parallel to the outer housing by the outer surface being guided by the outer housing.

11. The cosmetic product of claim 1, wherein the first container and the second container are formed of a transparent material.

12. The cosmetic product of claim 1, wherein the discharging unit includes:

a pumping part which generates pressure for pumping a mixed fluid of the first fluid and the second fluid; and a connecting surface which is coupled to the second container, wherein the first fluid and the second fluid which have been mixed in the first storing space are discharged to the outside of the discharging unit by the pressure of the pumping part resulting from a pressing action of a user.

13. The cosmetic product of claim 1, wherein the blade unit includes:

a central part which receives a rotating force from the rotating unit to serves as a rotational center; and a second container insertion part which is formed in a shape surrounding the second container, wherein the blade is disposed around the second container insertion part, and wherein when the second container is coupled to the first container, the second container is moved while being guided by the second container insertion part.

14. The cosmetic product of claim 13, wherein the blade unit includes:

a first plate which is connected to the central part, and which has a shape of a plate disposed at one side of the first container; and a second plate which is connected to the second container insertion part, and which has a shape of a plate disposed at another side of the first container, wherein one side of the blade is connected to the first plate, and another side of the blade is connected to the second plate, and wherein the blade has a continuous shape between the first plate and the second plate.

15. The cosmetic product of claim 1, further comprising a driving force transferring unit, which is provided at one side of the first container, and which transfers the rotation of the rotating unit to the blade unit.

* * * * *